US006735818B2

(12) United States Patent
Hamada et al.

(10) Patent No.: US 6,735,818 B2
(45) Date of Patent: May 18, 2004

(54) UPRIGHT TYPE ELECTRIC VACUUM CLEANER

(75) Inventors: Atsuo Hamada, Kasai (JP); Kazuyoshi Yoshimi, Hyogo-Ken (JP); Atsushi Okuda, Hyogo-ken (JP); Naoki Suetsugu, Kasai (JP)

(73) Assignee: Sanyo Electric Co., Ltd., Osaka (JP)

( * ) Notice: Subject to any disclaimer, the term of this patent is extended or adjusted under 35 U.S.C. 154(b) by 229 days.

(21) Appl. No.: 10/066,816

(22) Filed: Feb. 4, 2002

(65) Prior Publication Data

US 2002/0108208 A1 Aug. 15, 2002

(30) Foreign Application Priority Data

Feb. 9, 2001 (JP) ..... 2001-034374

(51) Int. Cl.[7] ..... A47L 9/32
(52) U.S. Cl. ..... 15/410; 15/352
(58) Field of Search ..... 15/327.1, 327.2, 15/327.6, 327.7, 350, 351, 352, 353, 410

(56) References Cited

U.S. PATENT DOCUMENTS 6,279,196 B2 * 8/2001 Kasen et al. ..... 15/320
6,442,791 B1 * 9/2002 McRae Thomson et al. .. 15/334
2002/0116907 A1 * 8/2002 Gammack et al. ..... 55/345

* cited by examiner

*Primary Examiner*—Terrence R. Till
(74) *Attorney, Agent, or Firm*—Darby & Darby

(57) ABSTRACT

An upright vacuum cleaner includes a secure handle on an upper part of a dust collecting portion. The handle may be used for transporting both the dust collection portion and the upright vacuum cleaner. The handle allows simplified construction, reduced costs, and increased user safety. An attachment mechanism provides secure double locking protection against accidental separation without simultaneous two-part operation and has a latching hook and a locking part which positively engage the dust collection portion and the vacuum cleaner body.

9 Claims, 7 Drawing Sheets

UPRIGHT TYPE ELECTRIC VACUUM CLEANER

BACKGROUND OF THE PRESENT INVENTION

1. Field of the Invention

The present invention relates to an upright electric vacuum cleaner. More specifically, the present invention relates to an upright electric vacuum cleaner providing secure part latching, simplified construction, ergonomic economy, and an increase in design range.

2. Description of the Related Art

Conventionally in upright electric vacuum cleaners, a handle for carrying a vacuum cleaner body and a handle for carrying a dust collecting part were formed separately. As an unfortunate consequence of this conventional construction, there was a large limitation on the design, an unnecessary increase in design and supply costs, a reduction in equipment strength, and increased risk of user strain.

OBJECTS AND SUMMARY OF THE INVENTION

It is an object of the present invention to provide an upright vacuum with simplified construction which overcomes the drawbacks of the related art noted above.

It is another object of the present invention to provide an upright type vacuum construction with a handle on an upper part of a dust collecting part. This handle is also used as a handle for carrying the vacuum cleaner body.

It is another object of the present invention to provide an upright type electric vacuum with simplified construction, lower manufacturing and supply costs, increased strength, and increased safety through a double-locking mechanism.

The present invention relates to an upright type electric vacuum cleaner which includes a handle on an upper part of a dust collecting portion. The handle may be used for transporting both the dust collection portion and the upright vacuum cleaner, construction is simplified, costs reduced, and safety increased. An attachment mechanism provides secure double locking protection against accidental separation without simultaneous two-part operation and includes a latching hook and a locking part which positively engage the dust collection portion and the vacuum cleaner body.

According to an embodiment of the present invention, there is provided an upright type electric vacuum cleaner, comprising: a suctioning tool body, a vacuum cleaner body, the vacuum cleaner body extending in a freely pivoting manner away from the suctioning tool body, a dust collecting part, the dust collecting part being detachably attached to the vacuum cleaner body on a first side of the vacuum cleaner body, an attachment mechanism for detachably attaching the dust collecting part and the vacuum cleaner body, a first handle formed on an upper portion of the dust collecting part, enabling an attachment and a detachment of the duct collection part from the vacuum cleaner body, and easy transport of the upright type electric vacuum cleaner during the attachment, and the attachment mechanism includes means for double-locking the dust collecting part to the vacuum cleaner body, thereby providing a simultaneous secure double-locking engagement and preventing accidental removal of the dust collection part from the vacuum cleaner body.

According to another embodiment of the present invention there is provided an upright vacuum cleaner, further comprising: a joining part in the double-locking means on the vacuum cleaner body, an operating part in the double-locking means in the first handle, a switch operation part in the double-locking means on the vacuum cleaner body, at least a first latching hook on operating part latchably engaging a latching part of the joining part during the engagement, and at least one locking part on the switch operating part lockably engaging a bottom side of the first latching hook during the engagement, whereby the means for double-locking provides double-locking engagement between the dust collecting part and the vacuum cleaner body and prevents separation without a simultaneous disengagement of both the switch operation part and the operating part.

According to another embodiment of the present invention there is provided an upright vacuum cleaner, further comprising: an operating body on the operating part, a detachment button and the first latching hook on the operating body, a tab at an end of the first latching hook, and a spring member in the operating body effective to elastically pivot the operating body about a support shaft when the detachment button is depressed.

According to another embodiment of the present invention there is provided an upright vacuum cleaner, wherein: the joining part includes an opening for receiving the first latching hook during the engagement, and the latching part is on an upper edge of the opening away from the suctioning tool body.

According to another embodiment of the present invention there is provided an upright vacuum cleaner, further comprising: a lock release button in the switch operation part, the lock release button extending through an opening formed on a front surface of the vacuum cleaner bod, the switch operating part extending toward the suction tool body and forming the locking part perpendicular to the first latching hook, an impelling spring in the switch operation part, and the impelling spring being effective to elastically pivot the switch operation part and the locking part about a second support shaft when the lock release button is pushed.

According to another embodiment of the present invention there is provided an upright vacuum cleaner, further comprising: a lower end part of the dust collection part, a front end part of a body receiving part, the body receiving part on the vacuum cleaner body between the suctioning tool body and the dust collecting part, whereby the dust collecting part is supportably retained between the attachment mechanism and the body receiving part during the engagement, and the lower end part and the front end part having respective first and second pivot shapes, whereby when both the lock release button and the detachment button are disengaged, the dust collection part is pivotable about respective lower end part and the front end part for allows easy separation of the dust collection part from the upright vacuum cleaner.

The above, and other objects, features, and advantages of the present invention will become apparent from the following description read in conjunction with the accompanying drawings, in which like reference numerals designate the same elements.

DESCRIPTION OF THE PREFERRED EMBODIMENTS

Figure 1:
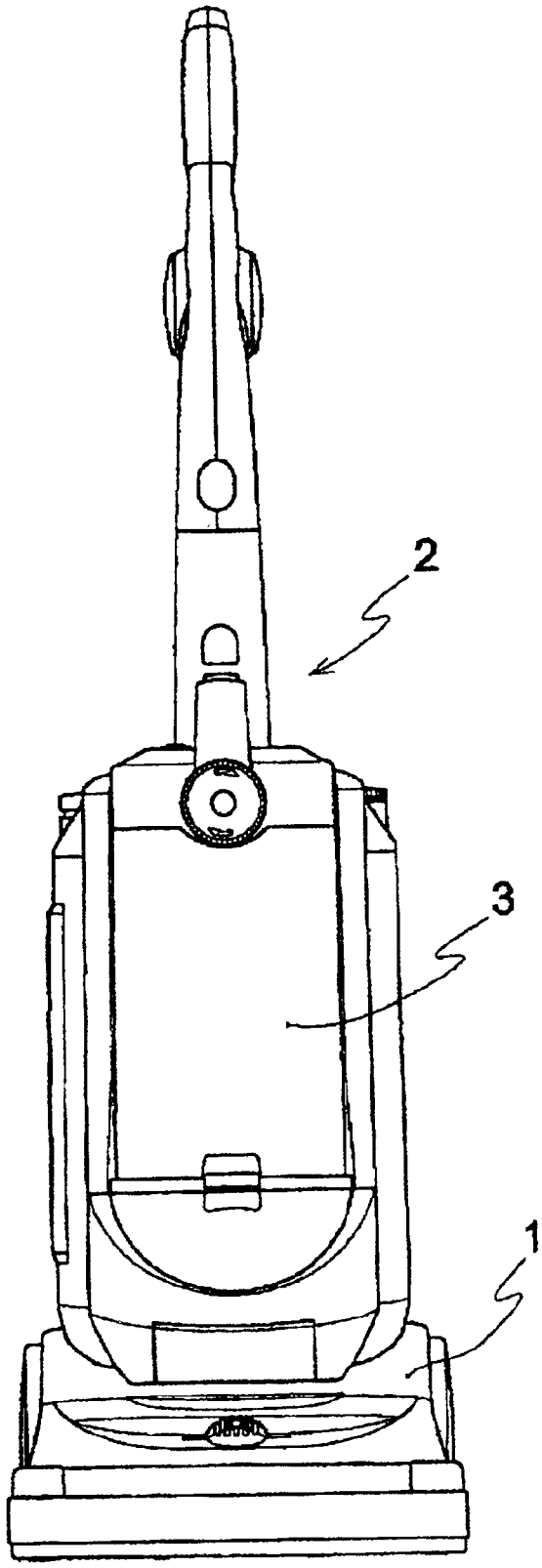
FIG. 1 is a front view of an embodiment of a vacuum cleaner according to an embodiment of the invention.
Figure 2:
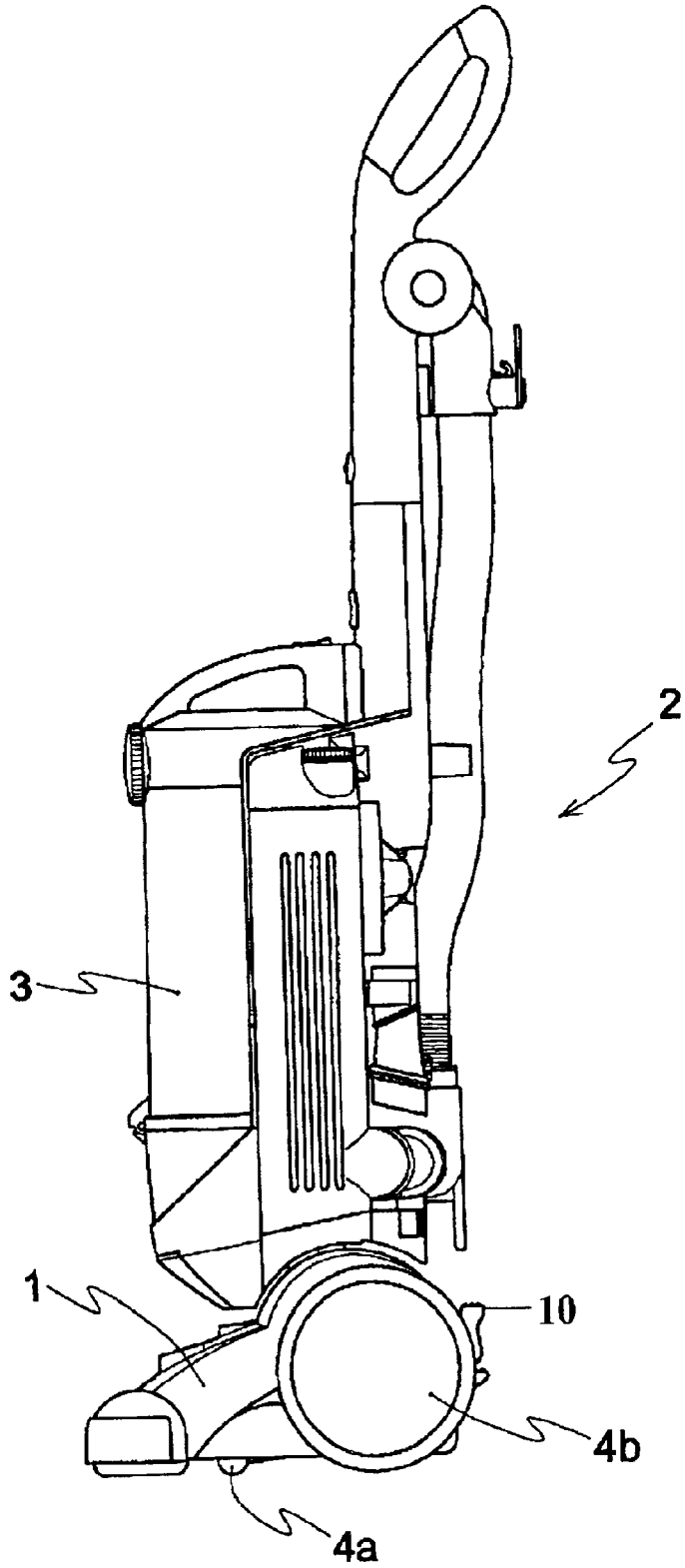
FIG. 2 is a side view of the vacuum cleaner of FIG. 1.
Figure 3:
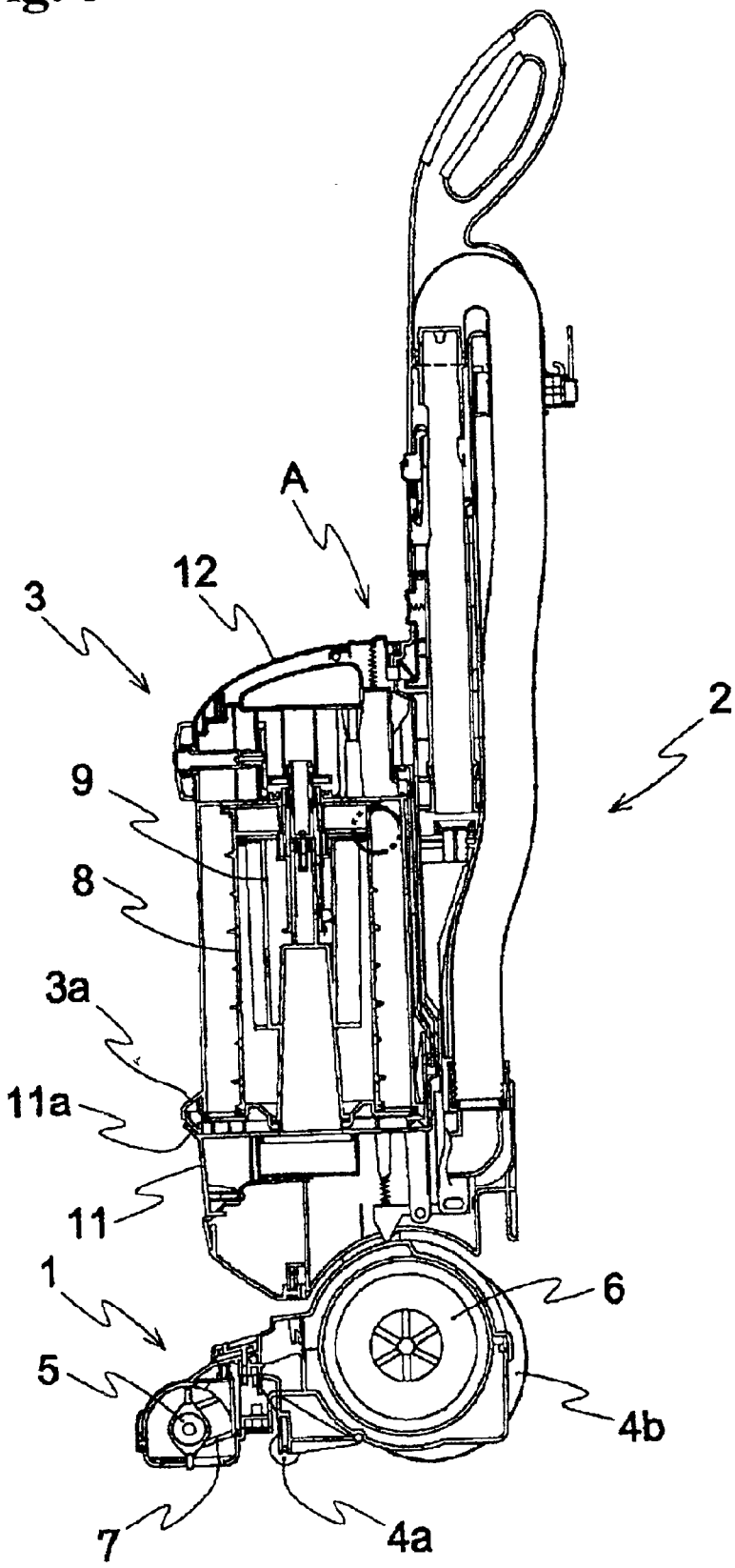
FIG. 3 is a vertical cross-section of the vacuum cleaner of FIG. 2.

Referring now to FIGS. 1–3, an upright type electric vacuum cleaner [hereinafter referred to as a vacuum cleaner] with a simplified construction includes a suctioning tool body 1, a vacuum cleaner body 2, and a dust collecting part 3.

First and second pairs of wheels 4*a*, 4*b* are disposed on respective front and rear portions of suctioning tool body 1. Wheels 4*a*, 4*b* functionally support and allow free movement of suctioning tool body 1 during use.

A rotating brush 5 extends outward through an opening in a bottom surface of suctioning tool body 1. During use, a belt 7, on a rotation shaft of an electric fan 6, drives a support shaft for rotating the rotating brush 5.

Electric fan 6 is housed between wheels 4*b*, 4*b* in the rear portion of suction tool body 1. During operation, the dust suctioned through suctioning tool body 1 collects, after filtering through a pre-filter 8 and a main filter 9 of a HEPA filter, inside dust collecting part 3 for later removal. Pre-filter 8 and main filter 9 are retained inside dust collecting part 3.

During operation and use, operating a vacuum cleaner operating part 10, attached to suction tool body 1, allows vacuum cleaner body 2 to swing freely with respect to suctioning tool body 1 and enable effective operation.

Dust collecting part 3 mounts on a body receiving part 11 on the front portion of vacuum cleaner body 1. An attachment mechanism A securely and detachably attaches dust collecting part 3 to vacuum cleaner body 2.

A handle 12 is formed on the upper portion of dust collecting part 3. Handle 12 is grasped for removing or attaching dust collecting part 3 to vacuum cleaner body 2. Handle 12 is also used for carrying dust collecting part 3 and vacuum cleaner body 2 when in an attached condition.

In the present embodiment, handle 12 is on the upper portion of dust collecting part 3 opposite a lower end part 3*a* a lower portion, as will be explained. A front end part 11*a* of body receiving part 11 securely supports lower end part 3*a*, as will be explained. During use, while holding handle 12, dust collecting part 3 is removably attached to vacuum cleaner body 2 on body receiving part 11. Consequently, removal and attachment of dust collecting part 3 is easy, waste removal is easily conducted, and the design is simplified, further benefitting the customer and reducing manufacturing costs.

Positioning handle 12 on the upper portion of dust collecting part 3 allows easy transport to a waste receptacle minimizing ergonomics strain on users and allaying physical stress. While assembled, vacuum cleaner body 2 may additionally be carried by handle 12. In this manner, handle 12 allows easy transport of both dust collecting part 3 individually, and dust collecting part 3 together with vacuum cleaner body 2 while assembled. Consequently, the necessity for construction of a separate handle for carrying the vacuum cleaner 2 body is eliminated and manufacturing costs are reduced, the structure of the vacuum cleaner body 2 is simplified, and a greater degree of freedom is afforded in design.

Since handle 12, for carrying dust collecting part 3, is also used as a handle for carrying vacuum cleaner body 2, employing handle 12 while moving the vacuum cleaner, there may exist a danger of accidentally releasing the lock mechanism (described later) in attachment mechanism A. Release of the lock mechanism in attachment mechanism A would likely result in detrimally detaching dust collecting part 3.

Consequently, a two-step locking mechanism is preferred, but the invention is not so limited in attachment mechanism A, as long as secure engagement is provided and unexpected disengagement is avoided.

Figure 4:
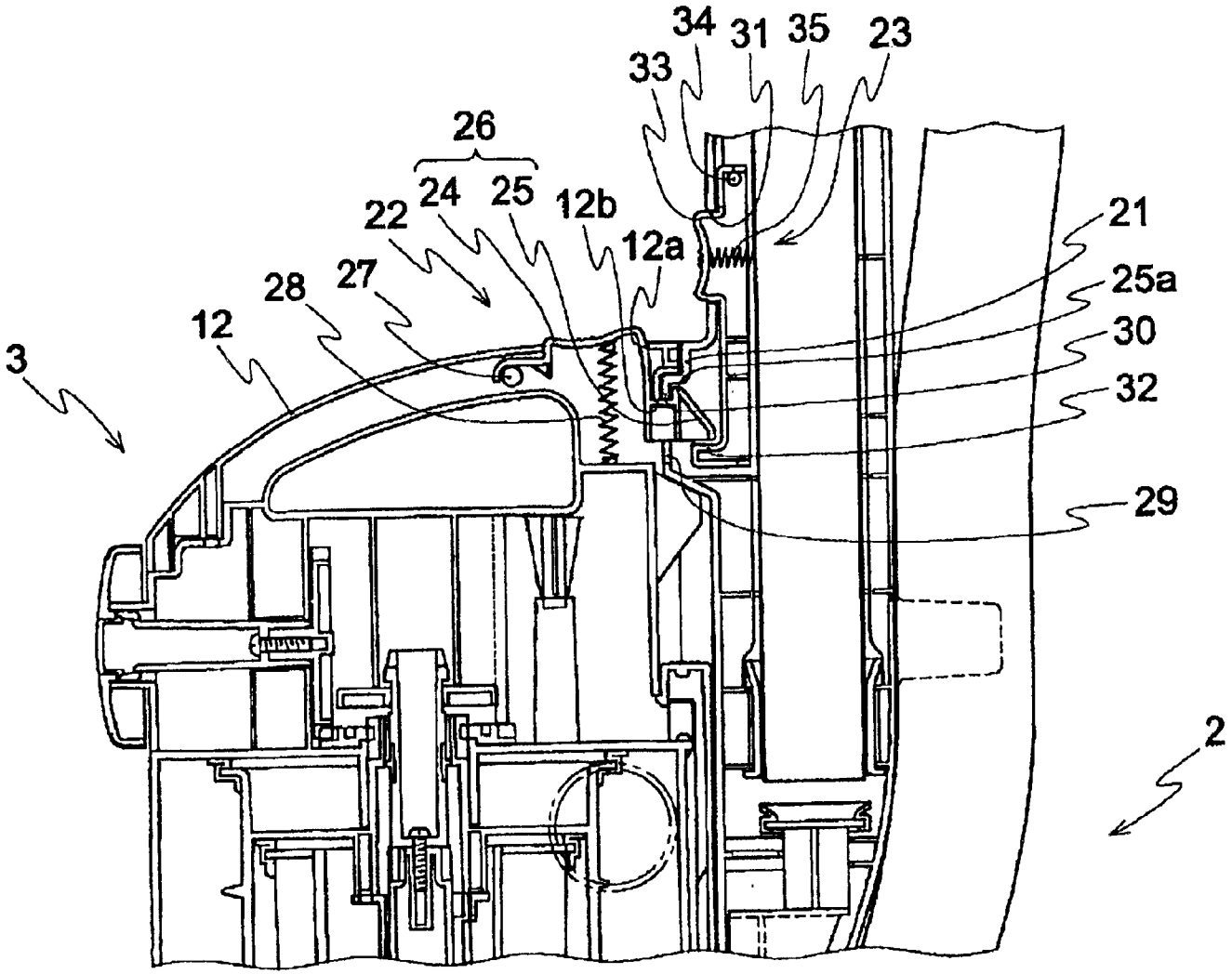
FIG. 4 is an enlarged view of the principal parts of the vacuum cleaner of FIG. 3.

Referring now to FIG. 4, a joining part 21, on vacuum cleaner body 2 engages an operating part 22 on handle 12 for the detachment and attachment operation of dust collecting part 3 with vacuum cleaner body 2. A switch operation part 23 on vacuum cleaner body 2 operates a lock release between operating part 22 and joining part 21. Consequently, vacuum cleaner body 2 and dust collecting part 3 are reliably engaged.

Operating part 22 is located inside an end of handle 12, as shown. Operating part 22 includes an operating body 26 having a detachment button 24 and a latching hook 25 with a tab 25*a*. Both detachment button 24 and latching hook 25 are respectively exposed to an upper surface opening 12*a* and a side surface opening 12*b* of handle 12. Operating part 22 further includes an impelling spring 28 which urges elastic pivoting of operating body 26 with respect to a support shaft 27.

Joining part 21 protrudes from the front surface of vacuum cleaner body 2. On a lower portion, joining part 21 includes a bounded opening 29 for adaptively receiving latching hook 25. On an upper edge of opening 29, joining part 21 includes a latching part 30 which operably latches with tab 25*a* of latching hook 25 during attachment.

Switch operation part 23 is positioned inside a front surface of vacuum cleaner body 2. Switch operation part 23 includes a lock release button 33 and an impelling spring 35. Lock release button 33 extends from an opening 31 on the front surface of vacuum cleaner body 2 and extends downward in an L-shaped locking part 32. Locking part 32 is positioned for engagement with a lower portion of latching hook 25. A spring 35, in switch operation part 23, elastically urges lock release button 33 to pivot about a support shaft 34 and actuate switch operation part 23 to engage or disengage dust collecting part 3.

Switch operation part 23 provides additional attachment safety to transportation of the vacuum cleaner by handle 12. Consequently, when vacuum cleaner body 2 is carried by handle 12, even if detachment button 24 is accidentally pressed, the lower surface of latching hook 25 remains held in place by locking part 32 and is locked to prevent unintended removal of dust collecting part 3.

Figure 5:
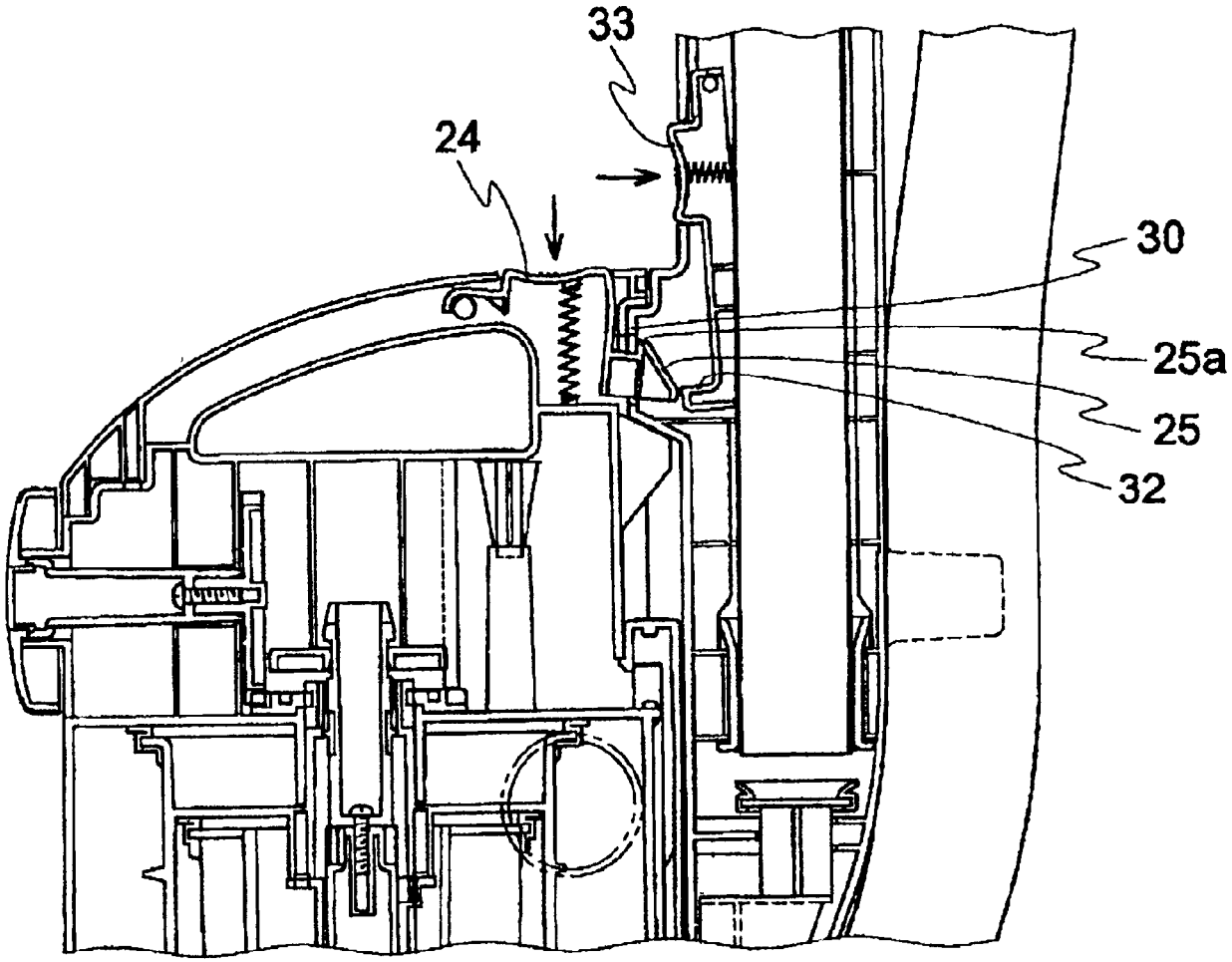
FIG. 5 is a first detail drawing illustrating removal of a dust collecting part.
Figure 6:
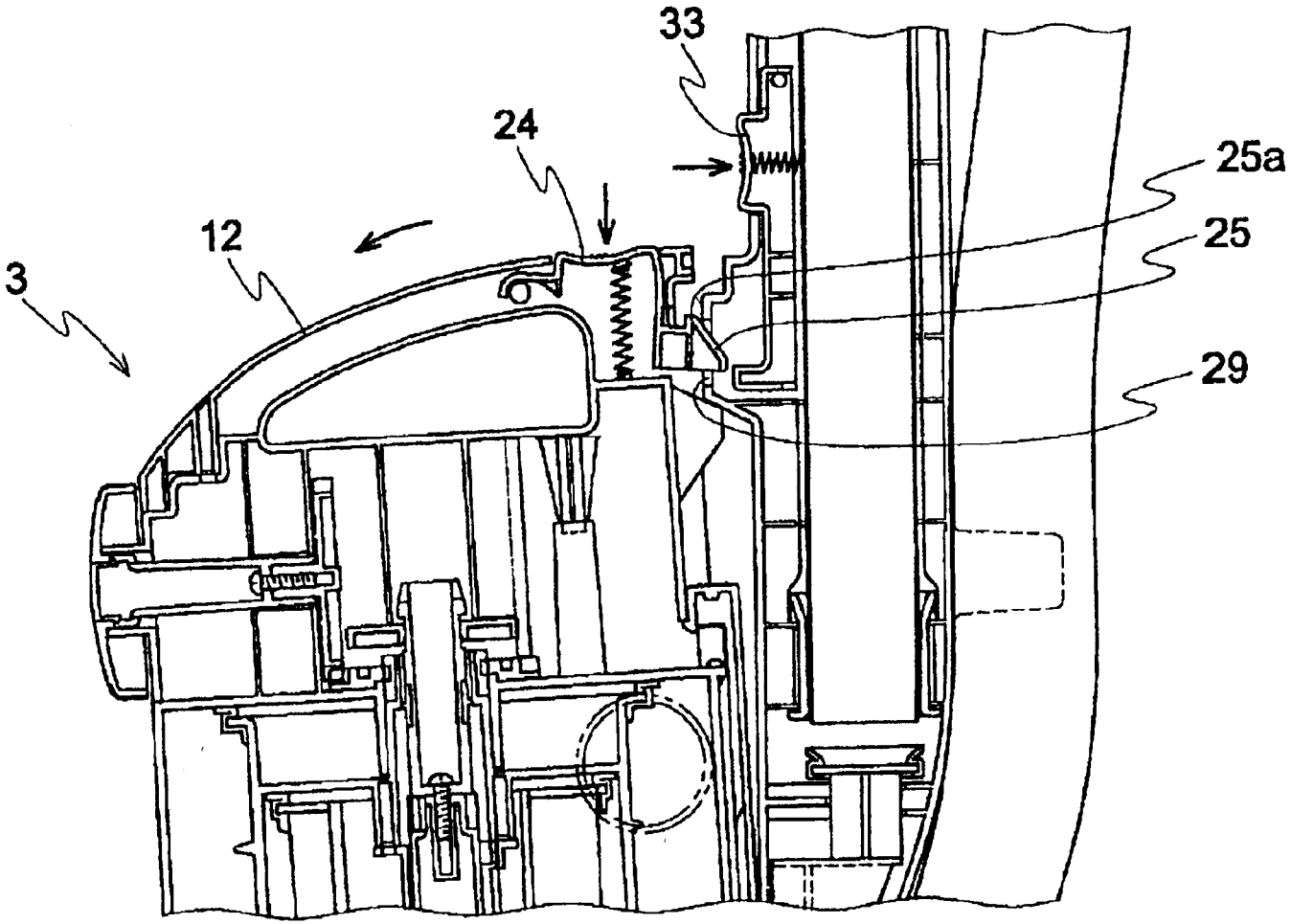
FIG. 6 is a second drawing illustrating removal of the dust collecting part.

Referring now to FIGS. 5 and 6, the removal process for dust collecting part 3 begins by first pressing detachment button 24 then lock release button 33 to pivot locking part 32. By following this removal process, the safety lock provided by locking part 32 is released which correspondingly releases latching hook 25.

As latching hook 25 pivots, tab 25*a* is released from latching part 30. Opening 29 provides space to allow handle 12 to be pulled forward, away from vacuum cleaner body 2. As handle 12 moves, dust collecting part 3 swings using lower end part 3*a* as a pivot point. Front end part 11*a* of body receiving part 11 supports lower end part 3*a* and minimizes flexing damage.

Figure 7:
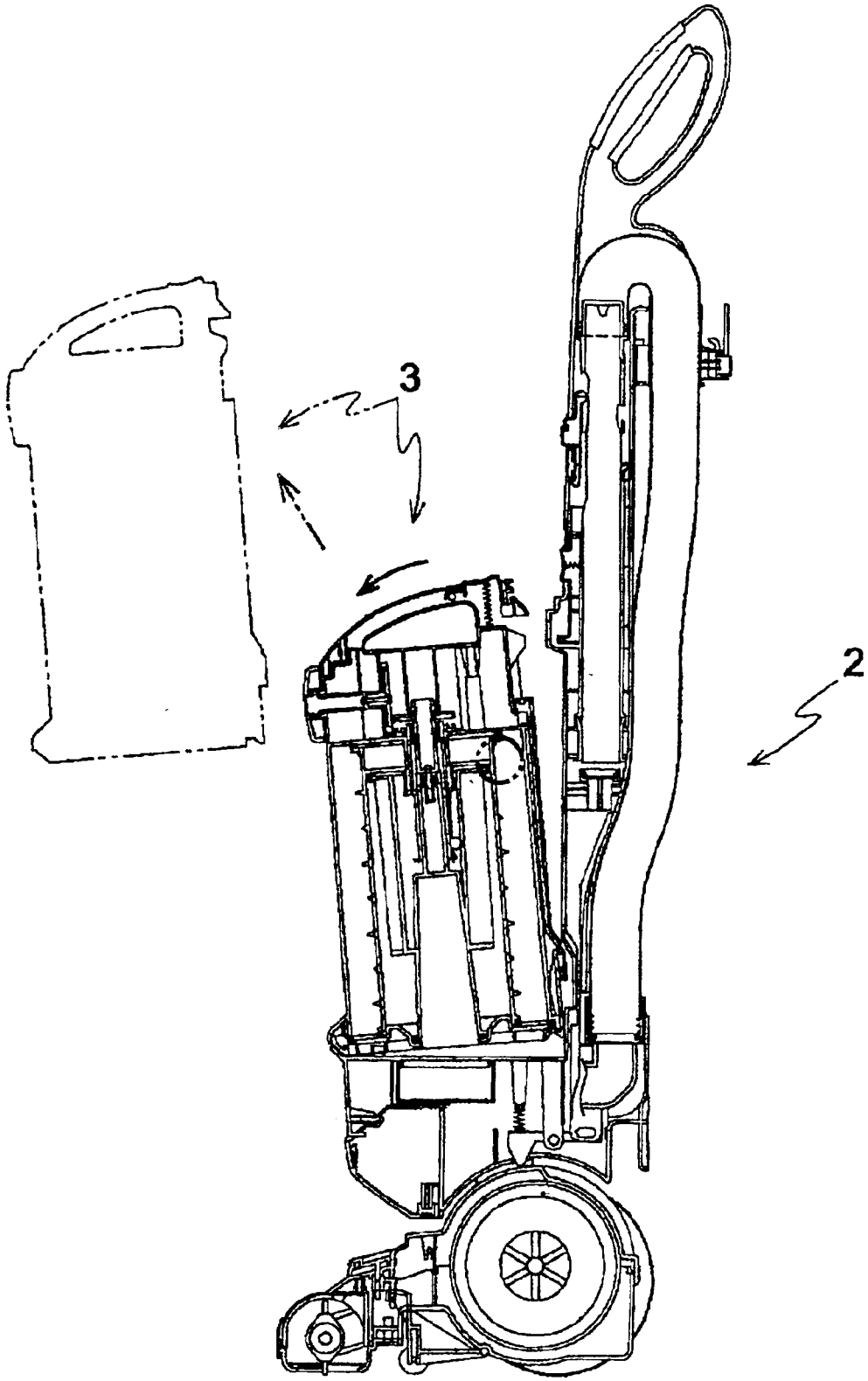
FIG. 7 is a third drawing illustrating removal of the dust collecting part.

Referring now to FIG. 7, dust collection part 3 is completely separated from vacuum cleaner body 3 by continued pulling, thereby making it available for carrying and cleaner. It should be understood, that by following the above process in reverse, dust collecting part 3 is easily and securely reattached to vacuum cleaner body 2.

In the present embodiment, vacuum cleaner body 2 securely includes switch operation part 23. Consequently, when holding handle 12, dust collecting part 3 may be easily removed only by operating operating part 22 while releasing locking part 32 of switch operation part 23. As a result, accidental removal of dust collecting part 3 is prevented and damage risk is minimized.

As described above, according to the present invention, since handle 12 is useable for both carrying dust collecting part 3 and as a handle for carrying vacuum cleaner body 2, the structure of vacuum cleaner body 2 is simplified and can be made inexpensively.

Additionally, there is a corresponding increase in design freedom resulting from the present invention. Further, since handle 12 is on the top portion of dust collecting part 3, waste removal is conducted easily.

The present invention should also be recognized as providing a healthy ergonomic advantage to the vacuum user. Particularly, since handle 12 is advantageously positioned both lower (about user-hand-high) than a top handle (shown but not described) on vacuum cleaner body 2 and closer to the center of gravity of the assembled vacuum cleaner, less physical strain is applied to a vacuum user. To carry the vacuum, the vacuum user can more easily and more conveniently grasp handle 12, with less shoulder strain, than a top handle. Carrying the vacuum cleaner by handle 12 provides greater control than carrying by the top handle. Consequently, positioning handle 12 as shown, with additional latch security provided promotes safe and healthy consumer use of the invention and minimizes physical strain risk.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the spirit and scope of this invention as defined in the following claims. In the claims, means-or step-plus-function clauses are intended to cover the structures described or suggested herein as performing the recited function and not only structural equivalents but also equivalent structures. Thus, for example, although a nail, a screw, and a bolt may not be structural equivalents in that a nail relies entirely on friction between a wooden part and a cylindrical surface, a screw's helical surface positively engages the wooden part, and a bolt's head and nut compress opposite sides of at least one wooden part, in the environment of fastening wooden parts, a nail, a screw, and a bolt may be readily understood by those skilled in the art as equivalent structures.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An upright vacuum cleaner, comprising:

a suctioning tool body;

a vacuum cleaner body;

said vacuum cleaner body extending in a freely pivoting manner away from said suctioning tool body;

a dust collecting part;

said dust collecting part being detachably attached to said vacuum cleaner body on a first side of said vacuum cleaner body;

an attachment mechanism for detachably attaching said dust collecting part and said vacuum cleaner body;

a first handle on an upper portion of said dust collecting part;

means for enabling attachment and detachment of said duct collection part from said vacuum cleaner body;

said first handle being positioned to provide easy transport of said upright vacuum cleaner during said attachment and detachment; and said means for enabling attachment including means for double-locking said dust collecting part to said vacuum cleaner body, thereby providing a simultaneous secure double-locking engagement and preventing accidental removal of said dust collection part from said vacuum cleaner body.

2. An upright vacuum cleaner, according to claim 1, further comprising:

a joining part in said double-locking means on said vacuum cleaner body;

an operating part in said double-locking means in said first handle;

a switch operation part in said double-locking means on said vacuum cleaner body;

at least a first latching hook on operating part latchably engaging a latching part of said joining part during said engagement; and at least one locking part on said switch operating part lockably engaging a bottom side of said first latching hook during said engagement, whereby said means for double-locking provides double-locking engagement between said dust collecting part and said vacuum cleaner body and thereby prevents separation without a simultaneous disengagement of both said switch operation part and said operating part.

3. An upright vacuum cleaner, according to claim 2, further comprising:

an operating body on said operating part;

a detachment button and said first latching hook on said operating body;

a tab at an end of said first latching hook; and a spring member in said operating body effective to elastically pivot said operating body about a support shaft when said detachment button is depressed.

4. An upright vacuum cleaner, according to claim 3, wherein:

said joining part includes an opening for receiving said first latching hook during said engagement; and said latching part is on an upper edge of said opening away from said suctioning tool body.

5. An upright vacuum cleaner, according to claim 4, further comprising:

a lock release button in said switch operation part;

said lock release button extending through an opening formed on a front surface of said vacuum cleaner body;

said switch operating part extending toward said suction tool body and forming said locking part perpendicular to said first latching hook;

an impelling spring in said switch operation part; and said impelling spring being effective to elastically pivot said switch operation part and said locking part about a second support shaft when said lock release button is pushed.

6. An upright vacuum cleaner, according to claim 5, further comprising:

a lower end part of said dust collection part;

a front end part of a body receiving part;

said body receiving part on said vacuum cleaner body between said suctioning tool body and said dust collecting part, whereby said dust collecting part is supportably retained between said attachment mechanism and said body receiving part during said engagement; and said lower end part and said front end part having respective first and second pivot shapes, whereby when both said lock release button and said detachment button are disengaged, said dust collection part is pivotable about respective lower end part and said front end part for allows easy separation of said dust collection part from said upright vacuum cleaner.

7. An upright vacuum cleaner comprising:

a vacuum cleaner body;

a dust collection part;

means for attaching said dust collection part to said vacuum cleaner body;

locking means for said attaching;

said locking means including at least first and second independent locking devices; and both said first and second locking devices requiring actuation before said dust collection part is removable from said vacuum cleaner body.

8. An upright vacuum cleaner according to claim 7, further comprising:

a handle on an upper portion of said dust collection part; and said handle being positioned to permit carrying of said upright vacuum cleaner when said dust collection part is attached to said body.

9. An upright vacuum cleaner according to claim 7 wherein said actuation may be sequential.

* * * * *